United States Patent [19]

Lundgren et al.

[11] 4,093,386

[45] June 6, 1978

[54] DEVICE FOR APPLICATION OF LIQUID PRODUCTS, SUCH AS PAINT, GLUE AND THE LIKE

[76] Inventors: Stig Gunnar Lundgren; Lars Johan Tornell, both of Goteborg, Sweden

[21] Appl. No.: 736,162

[22] Filed: Oct. 27, 1976

[51] Int. Cl.[2] ..... B44D 3/28

[52] U.S. Cl. ..... 401/219

[58] Field of Search ..... 401/208, 219, 220, 218

[56] References Cited

U.S. PATENT DOCUMENTS

| | | | |
|---|---|---|---|
| 3,263,264 | 8/1966 | Leland | 401/219 |
| 3,356,442 | 12/1967 | Leland | 401/219 |
| 3,622,246 | 11/1971 | Grooms | 401/219 |
| 3,850,532 | 11/1974 | Kaiser | 401/219 |

*Primary Examiner*—Stephen C. Pellegrino
*Attorney, Agent, or Firm*—Witherspoon, Lane & Hargest

[57] ABSTRACT

A device for application of liquid products, such as paints and the like, comprising a container holding the main quantity of the product and with a discharge opening therein, and an applicator roller. An elongate chamber is provided between the discharge opening and the applicator roller in a position beneath the roller and with a paint supply slot at its top wall. The roller is mounted in front of the container and above the chamber in a manner ensuring that the roller, when rotated, picks up a controlled amount of paint on its periphery. The device is equally suitable for painting vertical and horizontal surfaces. By tilting the device into various positions of inclination or by providing special means it is possible to control the amount of liquid to be picked up by the roller and also the speed of liquid outflow. Means are provided to allow use of applicator rollers of various kinds and having different circumferential dimensions.

6 Claims, 8 Drawing Figures

DEVICE FOR APPLICATION OF LIQUID PRODUCTS, SUCH AS PAINT, GLUE AND THE LIKE

BACKGROUND OF THE INVENTION

The present invention relates to a device for application of liquid products such as paint, glue and similar products and comprises a container holding the product and an applicator roller which is mounted at the front wall of the container and communicates with the container interior via a discharge aperture formed in the front wall of the container.

A prior-art paint applicator device comprises a container holding the liquid product and a pan in communication therewith and into which the roller dips to pick up paint. However, this device is suitable for painting of ceilings only, as it may not be tilted sufficiently to allow the roller to come into contact with a vertical wall to paint the same.

This prior-art device also has the further disadvantage that the paint may not without further flow from the container to the pan. The passage between the container and the pan is such as to necessitate tilting of the device to allow paint to flow from the container to the pan, and in order that this operation be possible, the device must be turned away from the ceiling sufficiently far to avoid abutment of the upper face of the device against the ceiling. As a result, the painting job must be interrupted from time to time. This prior-art device thus fails to provide continuous supply of paint to the application roller.

SUMMARY OF THE INVENTION

In accordance with the present invention the disadvantages outlined above have been completely eliminated.

The device is characterised in that an elongate chamber is provided between the discharge aperture of the container and the applicator roller, which chamber is positioned underneath the roller and the top section of which is provided with a paint supply slot extending in the longitudinal direction of the roller, that the roller is mounted in wall sections positioned in front of the container and above the chamber at ends thereof in such a manner that a portion of the roller periphery extends closely above the paint supply slot and the roller projects above as well as beyond these wall sections, and that the discharge aperture extends along the front wall of the container, having its lower delimitation line level with the bottom of the container.

BRIEF DESCRIPTION OF THE DRAWINGS

The invention will be described in more detail in the following with reference to one embodiment thereof illustrated in the accompanying drawings, wherein.

Figure 1:
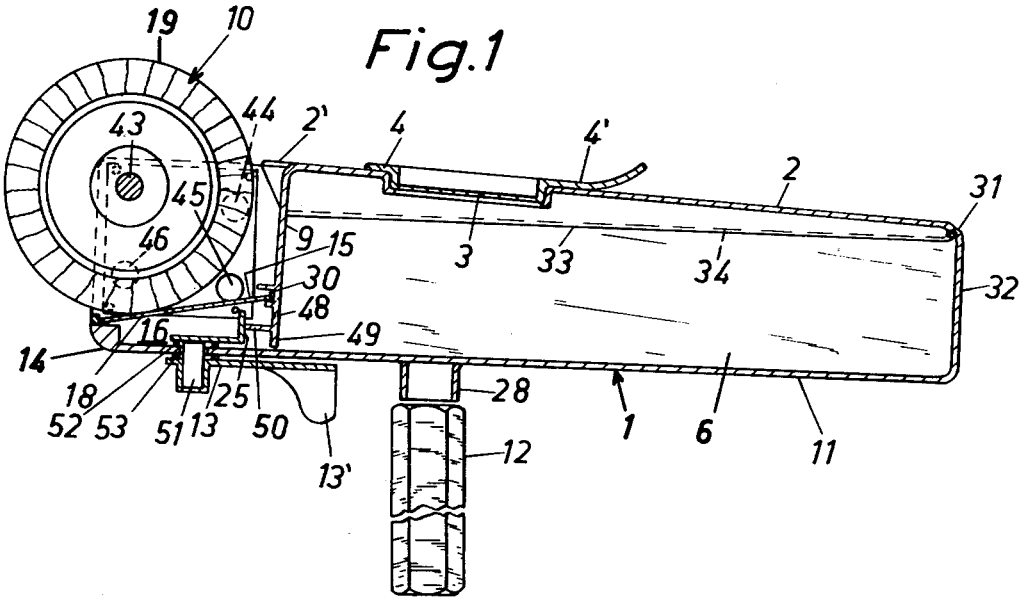
FIG. 1 is a longitudinal sectional view through the device.

The container which is generally designated by numeral reference 1 is provided on its top face 2 with a refill opening 3 and with a lid 4 fitting the latter. The side walls 5, 6 are provided with prolongations forming wall sections 7 and 8, respectively, extending forwards, past the front wall 9 of the container. The roller 10 is positioned in front of the container and may be mounted directly in the prolonged wall sections 7 and 8. At the lower face 11 of the container is attached a handle 12, and a control member 13 the function of which will be described later, is rotatably mounted on the said face.

Figure 3:
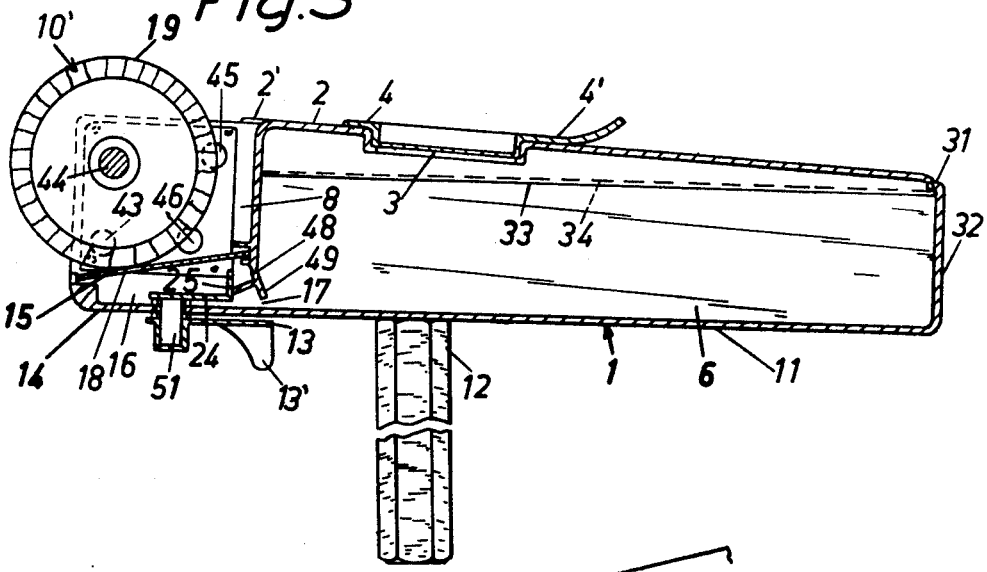
FIG. 3 illustrates the device in accordance with FIG. 1 but equipped with a smaller roller.

As appears from FIGS. 1 and 3, a chamber 16 is formed by the prolonged wall sections 7, 8 together with a prolonged section 14 of the container bottom and a cover slab 15 positioned underneath the roller 10, and this chamber 16 communicates via a discharge opening 17 with the interior of the container, and via a slot 18 formed in the slab 15 it opens towards the roller 10. The peripheral soft part 19 of the application roller, consisting e.g. of bristles or foam rubber, abuts closely against the slot and when rotated it picks up paint or the like through the slot.

Figure 2:
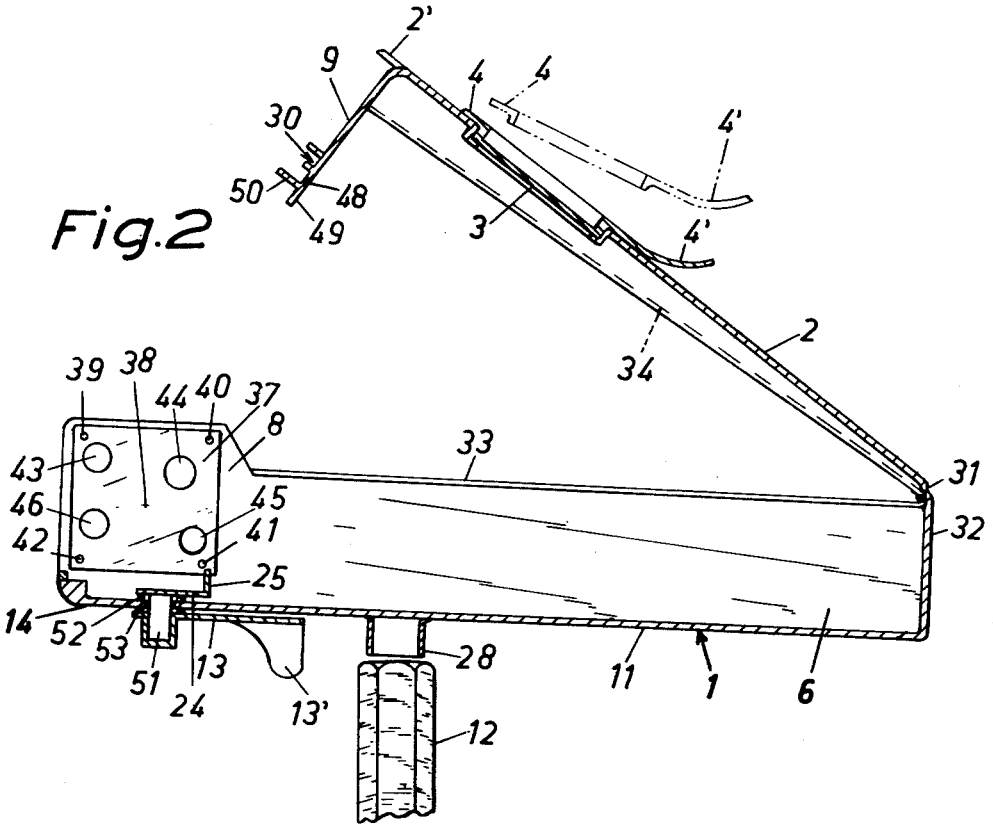
FIG. 2 is a longitudinal sectional view through the device according to FIG. 1 after removal of the application roller and opening of the container.

As appears from FIGS. 1 - 3, the control member 13 is rigidly connected with an arm 24 which is positioned inside the chamber 16 and may be turned upon actuation of the control member. The free end of the arm supports an upright section 25 which is arranged for engagement with the front wall 9 to bend the latter away, as will be described more closely in the following.

The handle 12 is of hexagonal cross-sectional shape and provided with a hexagonal opening into which a matching shoulder 28 provided on the lower face of the container is fitted to secure the handle.

The top face 2 and the bottom face 11 of the container are flat and the height of the container is less than the diameter of the roller 10.

The lid 4 provided on the upper face of the container is provided with a pulling tab 4', whereby removal of the lid is facilitated. The top 2 of the container is integral with the front wall 9 thereof and adjacent the latter formed with a pulling tab 2'. The container wall 9 is provided with a channel 30 into which is inserted the marginal portion of the removable covering slab 15 serving as the upper wall of the chamber 16.

As appears from FIG. 2, the top 2 of the container is connected to the rear wall 32 thereof via a horizontal hinge connection 31. The top of the container may be swung upwards about the hinge 31 together with the front wall 9. The side walls 5, 6 of the container are provided at their upper part with a marginal portion 33 which, upon folding down of the top of the container to close the latter, is received in grooves 34 formed in portions projecting downwardly from the container top, whereby a so-called labyrinth seal is formed between the top and the side walls of the container. As mentioned in the afore-going, the side walls are prolonged in the forwards direction by means of wall sections 7, 8 serving on the one hand as the side walls of the chamber and on the other as mounting members to the roller 10.

Figure 6:
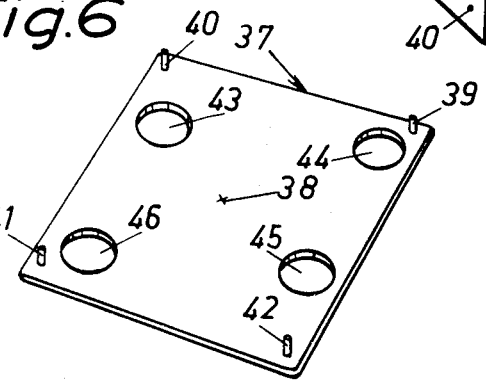
FIG. 6 illustrates a mounting plate in accordance with a first embodiment.
Figure 7:
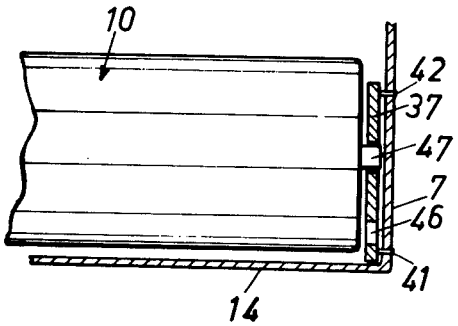
FIG. 7 illustrates this plate in position of use for support of the roller.

On the inner face of the wall sections 7, 8 are provided mounting plates 37 which are provided with pins 39, 40, 41, and 42 positioned symmetrically about the centre 38 of the plate, and with mounting apertures 43, 44, 45, 46 positioned non-symmetrically about the plate centre. FIG. 6 illustrates the plate in a perspective view, and FIG. 7 the attachment of the mounting plate to the wall sections 7, 8 by insertion of the pins in corresponding holes formed in the wall sections. The two mounting plates are of identical configuration and are secured to the inner face of their associate wall section 7, 8 in mirror-image fashion relative to one another, i.e. the mounting holes in one plate are positioned opposite the corresponding holes in the other plate. The end portions 47 of the roller trunnions are inserted in their associated mounting holes in the mounting plates.

As illustrated in FIG. 1, the roller 10 is to touch tangentially the upper part 15 of the chamber 16 exactly in front of the supply slot 18 formed therein. The plates 37 are removable and may be turned about their centre to be set in a new position. Owing to the symmetrical positioning of the four pins about the centre 38 of the plates, the latter may be set in four different positions and, because of the non-symmetrical disposition of the mounting holes, it becomes possible to vary the distance between the slot 18 and the mounting hole corresponding to the set position of use. In the device illustrated in FIG. 3, the mounting plates have been turned over a quarter of a turn relative to the position shown in FIG. 1, and the hole 44 is positioned at a smaller distance from the slot 18 than is the hole 43 in the position of FIG. 1. A roller 10' mounted in the mounting holes 44, has a smaller diameter than the roller illustrated in FIG. 1, but also the periphery of the smaller roller 10' touches the discharge slot 18.

The front wall 9 of the container is provided beneath the groove 30 with a hinge 48 formed by a reduction of the thickness of the material. The lower portion 49 of the front wall may be bent upwards away from the container bottom so as to form an opening of adjustable width between the container and the chamber 16. When the actuation arm 24 is being turned, one 25 of its ends is displaced along a flange 50 projecting from the flexible portion about the hinge 48 for the purpose of adjusting the size of the opening 17. The arm 24 may be turned about a shaft 51 and via this shaft it is connected to the control member 13 provided on the lower face of the chamber. Intermediate the arm 24 and the upper face of the bottom of the chamber and intermediate the member 13 and the lower face of the bottom of the chamber friction rings 52 and 53, respectively, are arranged around the shaft 51, these rings arranged to provide a frictional force between the arm, the member and the chamber faces, respectively, of such a magnitude that the arm 24 will remain in the position wherein it is set, while at the same time it may be easily turned by means of the control member 13. The latter is positioned comparatively close to the handle 12 of the device and is of sufficient length to allow the user which holds the handle by one hand, to reach the portion 13' of the control member 13 with the fingers of the hand holding the handle. FIG. 3 shows the control member turned into a different position, wherein the lower portion 49 (of the front wall 9) is bent upwards as a result of the free end 25 of the arm 24 pressing against the flange 50.

As mentioned in the afore-going, the chamber 16 communicates with the interior of the container via the discharge opening 17. By tilting the container into various angular positions, it is possible to vary the pressure of the liquid product in the chamber and thus the liquid pressure against the periphery of the roller passing above the slot 18. Upon its rotation the roller 10 will then soak up and carry along a flow of the product which varies depending on the liquid pressure. This effect is further enhanced by the flexibility of the slab 15, as the latter will be pressed against the roller with a force that varies with the variation of pressure inside the chamber, and as a result the roller will dip into the slot to a larger or smaller extent.

By changing the height of the discharge opening 17 it becomes possible to vary the speed of outflow of the liquid from the container. By adjusting the height of the opening in dependence on the viscosity of the different liquids, it becomes possible to achieve the desired discharge speed. The latter will depend on the speed of application of the liquid onto a surface, or on the desired thickness of the layer applied. The thickness of the layer applied on the surface is, as mentioned above, also dependent on the angular position of the container, i.e. on the pressure in the chamber, and on the depth of the peripheral portion of the roller into the slot 18.

The slot 18 is positioned at a distance from the forward edge of the covering slab 15, and the roller is mounted so as to ensure that a portion of the slab on either side of the slot is in alignment with a tangent to the roller opposite the slot 18. Owing to this arrangement paint, glue, and similar products may be applied irrespective of the direction of rotation of the roller. The structure is such that no other part of the device touches the roller, the latter only touching the slab 15 adjacent the slot.

When used for e.g. painting, the device is normally kept in the position illustrated in FIG. 3 (horizontal). This position naturally is necessary when ceilings are being painted, as the top 2 of the container 1 would otherwise abut against the ceiling. However, owing to the extension of the roller above the container, the structure illustrated also permits tilting of the device slightly during painting of ceilings.

Figure 4:
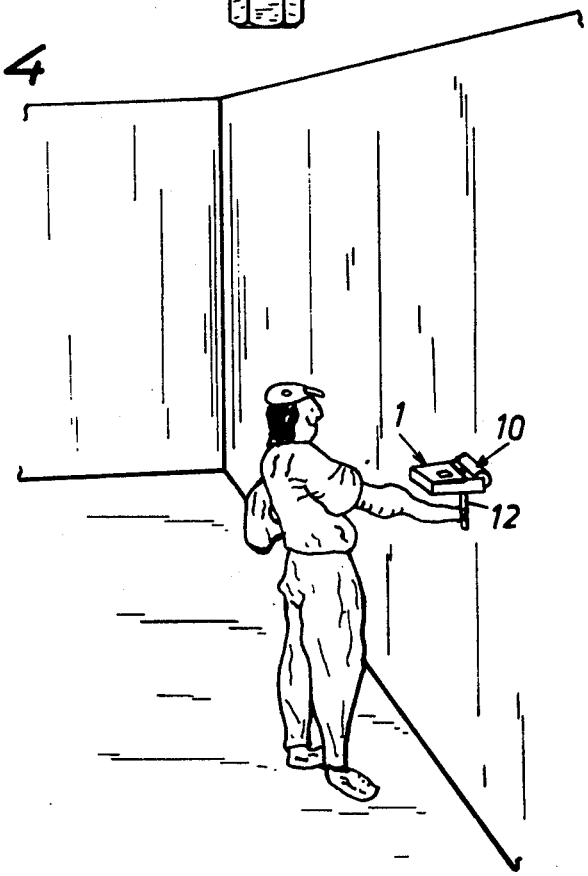
FIG. 4 illustrates the device in accordance with the invention when used for painting a wall.
Figure 5:
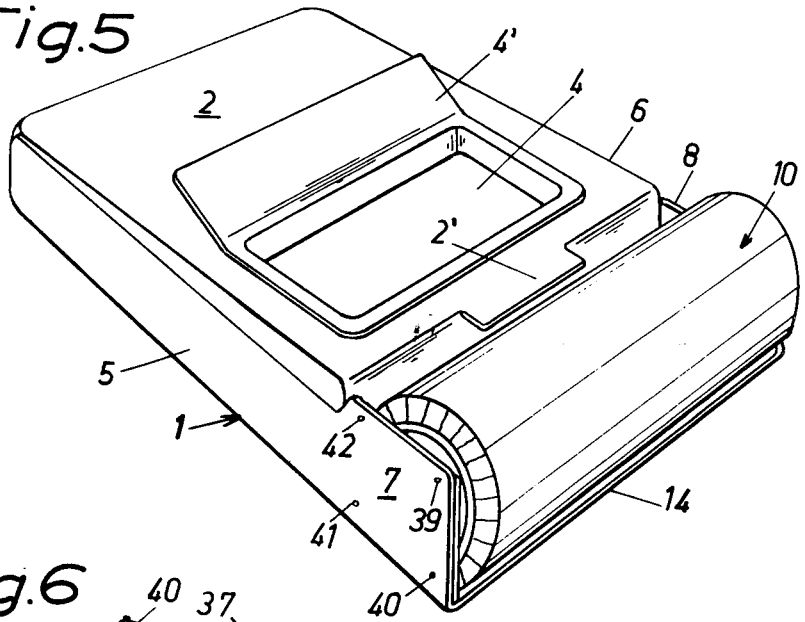
FIG. 5 illustrates the device in accordance with FIG. 1 in a perspective view from above.

FIG. 4 illustrates the manner in which the device is used for painting of walls. The painter grips the handle 12 by his one hand and moves the device upwards and downwards to apply the paint. As mentioned above, the painter may, while simultaneously moving the device in one hand, with the fingers of the same hand alter the size of the discharge opening 17. Owing to the possibility of altering the size of the opening by the same hand during the painting operation, there is no need to interrupt the painting, which could result in uneven application of the paint.

Figure 8:
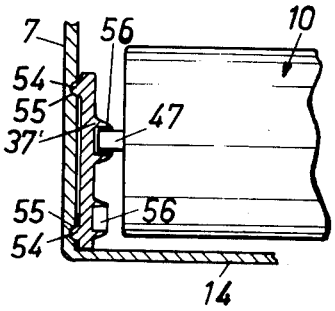
FIG. 8 illustrates a second embodiment of a mounting plate in position of use thereof.

FIG. 8 illustrates mounting plates 37' in accordance with a second embodiment. Instead of pins 39, 40, 41, 42, the mounting plates are provided with projections 54 in corresponding positions which are intended to be pressed into corresponding recesses 55 formed in the walls sections 7 and 8, which sections may consist of end wall portions projecting freely upright from the bottom. In accordance with this embodiment, the mounting holes 56 do not extend through the plates but merely are identations in the plates in the bottom of which the ends 47 of the trunnions of the roller 10 are seated to retain the mounting plates in position, i.e. they press the plates against the wall sections 7 and 8.

Owing to the arrangement of the device in accordance with the invention it is easy to exchange rollers of varying sizes and to clean the device after use. The device consists of moulded plastics and the wall sections 7, 8 are somewhat flexible to allow the roller 10 to be displaced in its lengthwise direction while bending one of the walls sections 7 or 8 outwards at one end of the roller until the end 47 of the trunnion at the opposite end of the roller is disengaged from the mounting hole. The roller may then be removed. Thereafter it is easy to remove the slab 15 and the container is opened by folding its top 2 together with the front wall 9 upwards away from the bottom 11 of the container, about the hinge 31. The entire interior of the container is then easily accessible for cleaning.

The invention is not limited to the embodiments described above but various modifications are possible within the scope of the appended claims. The number of mounting holes 43, 44, 45, 46, and 56, respectively, naturally is not limited to four but may be varied. Furthermore, the positions of the holes may on the whole be chosen arbitrarily.

The mounting plates need not be secured as described above. For instance, pins or projections formed in the sides of the wall sections may be inserted in holes or notches formed in the mounting plates to secure the latter.

The elongate supply slot 18 formed in the upper part of the chamber 16 may be replaced by several shorter slots arranged in succession in one or several rows in the transverse direction of the device.

In accordance with the embodiment illustrated the portion 49 which may be bent about the hinge 48 is arranged, upon resetting of the control member 13, to the original position thereof, to spring back to a vertical position.

To positively ensure that this flexible portion really springs back upon resetting of the control member to reduce the size of the opening 17, the device may be modified so as to provide for forced resetting. For instance, the arm 24 may be equipped with a pin on its free end, said pin arranged upon turning movement of the arm 24, to run in a slot or groove arranged lengthwise in the projecting flange 50 extending in parallel with the roller 10. Owing to this arrangement the flexible portion 49 will be forced to bend forwards and upwards and to be returned upon turning of the control member 13.

What we claim is:

1. An improved device for application of liquid products such as paint, glue and the like, comprising a container holding the aforesaid liquid, and an applicator roller, said roller mounted at the front wall of said container, a discharge opening formed in said front wall of the container, said opening communicating the interior of said container with said applicator roller, an elongated chamber arranged intermediate said discharge opening of said container and said applicator roller, said chamber positioned underneath said roller and having a paint supply slot formed in its top section, said paint supply slot extending in the longitudinal direction of said applicator roller, wall sections positioned in front of said container and above said chamber at the ends thereof, mounting plates for attachment of said applicator roller, said mounting plates removably arranged on said wall sections, a number of attachment elements arranged on said mounting plates in symmetrical positions relative to a certain point on each one of said plates, said attachment elements serving to retain said mounting plates to said wall sections, a plurality of mounting holes in said mounting plates to receive therein the trunnion ends of said applicator roller, said mounting holes disposed non-symmetrically relative to said point and in mirror-image fashion in the two mounting plates, said mounting plates arranged to be re-set so as to allow positioning of said mounting holes in their individual positions of use, each one of said mounting holes intended for an applicator roller of a certain size and type, said applicator roller mounted in said wall sections in a manner ensuring that a portion of the periphery of said roller extends closely above said paint supply slot and that said roller projects above as well as beyond these wall sections, and said discharge opening extending along the front wall of said container with its lower delimitation line level with the bottom of said container.

2. An improved device according to claim 1 wherein the container has a top wall and a rear wall, said top wall being integrally attached to the front wall and hingedly connected to the rear wall whereby the top wall and front wall swing upwardly together about this hinge point on the rear wall.

3. An improved device for application of liquid products such as paint, glue and the like, comprising a container holding the aforesaid liquid and having a top wall, a bottom and a front wall, an applicator roller, said roller mounted at the front wall of said container, a discharge opening formed in said front wall of the container, an elongated chamber forward of the container front wall and in communication with the discharge opening of said container, said chamber being positioned underneath said applicator roller and having a front with a top section extending rearwardly therefrom, said top section having a paint supply slot formed therein, said paint supply slot extending in the longitudinal direction of said applicator roller, rearwardly of the front of the chamber, wall sections positioned in front of said container and above said chamber at the ends thereof, said applicator roller mounted in said wall sections so that a portion of the periphery of said roller extends closely above said paint supply slot and so that said roller periphery projects above these wall sections and the top of the container and beyond said wall sections and the front of the chamber, and said discharge opening extending along the front wall of said container with its lower delimitation line level with the bottom of said container.

4. The device according to claim 3 and wherein the front wall of the container and top section of the chamber are resilient and flexible.

5. The device according to claim 4 and wherein means are provided to vary the size of the discharge opening.

6. The device according to claim 5 and wherein the means provided to vary the size of the discharge opening comprise an arm disposed inside said chamber with a portion in contact with the lower portion of the flexible front wall of the container, actuation means exterior of the chamber connected to the arm so that displacement of the actuation means will actuate the arm and flex the flexible front wall to vary the discharge opening.

* * * * *